United States Patent [19]

Portmann

[11] Patent Number: 4,748,883

[45] Date of Patent: Jun. 7, 1988

[54] APPARATUS FOR SETTING THE WORKING STROKE OF A PUNCHING MACHINE

[75] Inventor: August T. Portmann, Arbon, Switzerland

[73] Assignee: Bruderer AG, Frasnacht-Arbon, Switzerland

[21] Appl. No.: 13,969

[22] Filed: Feb. 12, 1987

[30] Foreign Application Priority Data

Apr. 28, 1986 [CH] Switzerland ..... 01726/86

[51] Int. Cl.[4] ..... B30B 1/06; B26D 7/26

[52] U.S. Cl. ..... 83/530; 72/422; 74/571 M; 74/603; 83/615; 83/628; 100/282

[58] Field of Search ..... 83/528, 530, 615, 628; 100/282, 257; 72/441, 452; 74/55, 571 M, 603

[56] References Cited

U.S. PATENT DOCUMENTS

| | | | |
|---|---|---|---|
| 3,611,918 | 10/1971 | Marsh | 83/615 X |
| 3,765,266 | 10/1973 | Carlise | 83/530 X |
| 4,156,387 | 5/1979 | Portmann | 83/530 X |
| 4,160,409 | 7/1979 | Portmann | 83/530 X |
| 4,354,411 | 10/1982 | Griese et al. | 83/530 X |
| 4,638,731 | 1/1987 | Kato | 100/282 |

*Primary Examiner*—E. R. Kazenske
*Assistant Examiner*—Hien H. Phan
*Attorney, Agent, or Firm*—Ladas & Parry

[57] ABSTRACT

A first eccenter sleeve allocated to the drive of the devices operative for the balancing of masses is drivingly connected to the eccenter shaft by means of a displaceable locking bolt. The first eccenter sleeve is provided with pins and slide rings engaging into slots in the second eccenter sleeves. The second eccenter sleeves are connected via punch connecting rods to the ram of the machine. Slides are supported in the machine frame, which slides can be moved into slots provided in the second eccenter sleeves. Accordingly, all three eccenter sleeves can be held against rotation on the eccenter shaft. The drive connection between eccenter shaft and all eccenter sleeves proceeds accordingly via one single connecting member, namely the locking bolt. And this locking bolt operates together with one eccenter sleeve. Accordingly, no splined shafts which must be machined extremely precisely but are prone to knock out during operation are necessary.

6 Claims, 2 Drawing Sheets

APPARATUS FOR SETTING THE WORKING STROKE OF A PUNCHING MACHINE

BACKGROUND OF THE INVENTION

1. Field of the Invention

The present invention relates to an apparatus for setting the working stroke of a punching machine which is selectively operable at two working strokes and includes two punch connecting rods drivingly coupled to the punching ram, and includes an eccenter shaft having a first eccenter section and two second eccenter sections, which first eccenter section is allocated to the drive of those machine members which are operative for the balancing of masses of the oscillating and rotating forces and is provided with a first eccenter sleeve rotatably supported thereupon, which second eccenter sections are allocated to the drive of the two punch connecting rods and are provided each with a second eccenter sleeve rotatably supported thereupon.

2. Description of the Prior Art

In order to change the working stroke of known punching machines having two punch connecting rods and means for the balancing of masses it is necessary to change three eccenter devices. The structural parts of such machines which must be rotated relative to each other to accomplish mentioned change include splined shafts and the operating thereof necessitates displacing claws. Because especially the eccenter structures allocated to the punch connecting rods demand an extremely exact synchronism, an intrinsic and exact working thereof during production is an absolute demand. The small play of the splined shafts which is necessary to allow a safe shifting of the claws is quite undesirable, specifically in case of high speed punching machines having very high plus/minus moments, which stem from the oscillating forces. Such splined shafts are prone to getting knocked out. Furthermore, the changing mechanism of such known punching machines having two punch connecting rods must attack on three displacing claws.

SUMMARY OF THE INVENTION

Hence, it is an object of the invention to provide an apparatus for setting the working stroke of a punching machine in which a first eccenter sleeve is releasably form-locked to a first eccenter section and thus the eccenter shaft and is at both sides continuously drivingly coupled to one respective of second eccentric sleeves, and includes a locking means supported by the machine frame, which locking means has an inoperative and a locking position and locks in its locking position all eccenter sleeves against a rotating.

This allows now a changing of the position of all three eccenter devices by one mechanism only. No structural members which are loaded by moments must be shifted. The coupling of the eccenter devices allocated to the punch connecting rods and operative to transmit the driving moment can be made at a large radius. Furthermore, the location of this transmitting of the driving moment to the eccenter device allocated to the drive of the devices operative for the balancing of masses, which transmission proceeds preferably via a locking bolt in latter eccenter device, may also have a large radius.

BRIEF DESCRIPTION OF THE DRAWINGS

The present invention will be more fully understood by reference to the following detailed description thereof, when read in conjunction with the attached drawings, and wherein.

DESCRIPTION OF THE PREFERRED EMBODIMENT

Figure 1:
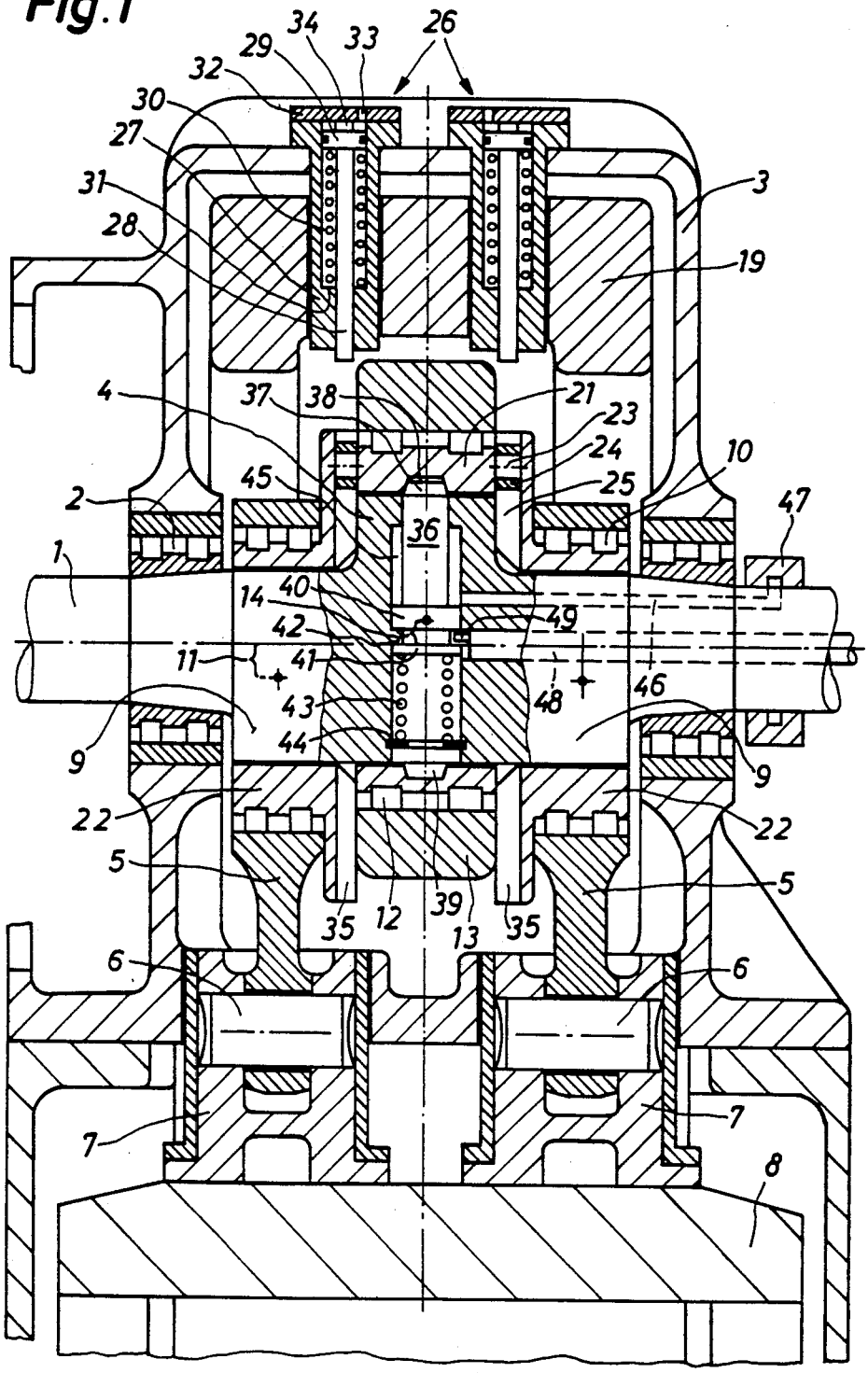
FIG. 1 illustrates a longitudinal section of a preferred embodiment of the present invention.

The eccenter shaft 1 is supported via friction less bearings 2 in the machine frame 3. The eccenter shaft includes a first eccenter section 4 allocated to the drive of both machine members which are operative for the balancing of masses of the oscillating and rotating forces. These balancing masses will be described more in detail further below. Two punch connecting rods 5 are supported on the eccenter shaft 1. Each punch connecting rod 5 is pivotably mounted via trunnions 6 to the ram 7, which is guided for vertical movement in the machine frame 3.

The eccenter shaft 1 includes two second eccenter sections 9, which are located immediately at both sides adjacent the first eccenter section 4. The punch connecting rods 5 are supported respectively, via frictionless bearings 10 on a second respective eccenter section 9. The eccentricity of the respective second eccenter sections 9 is identified by the reference numeral 11.

A yoke 13 is supported via frictionless bearings 12 on mentioned first eccenter section 4. The eccentricity of the first eccenter section 4 is identified by the reference numeral 14.

Figure 2:
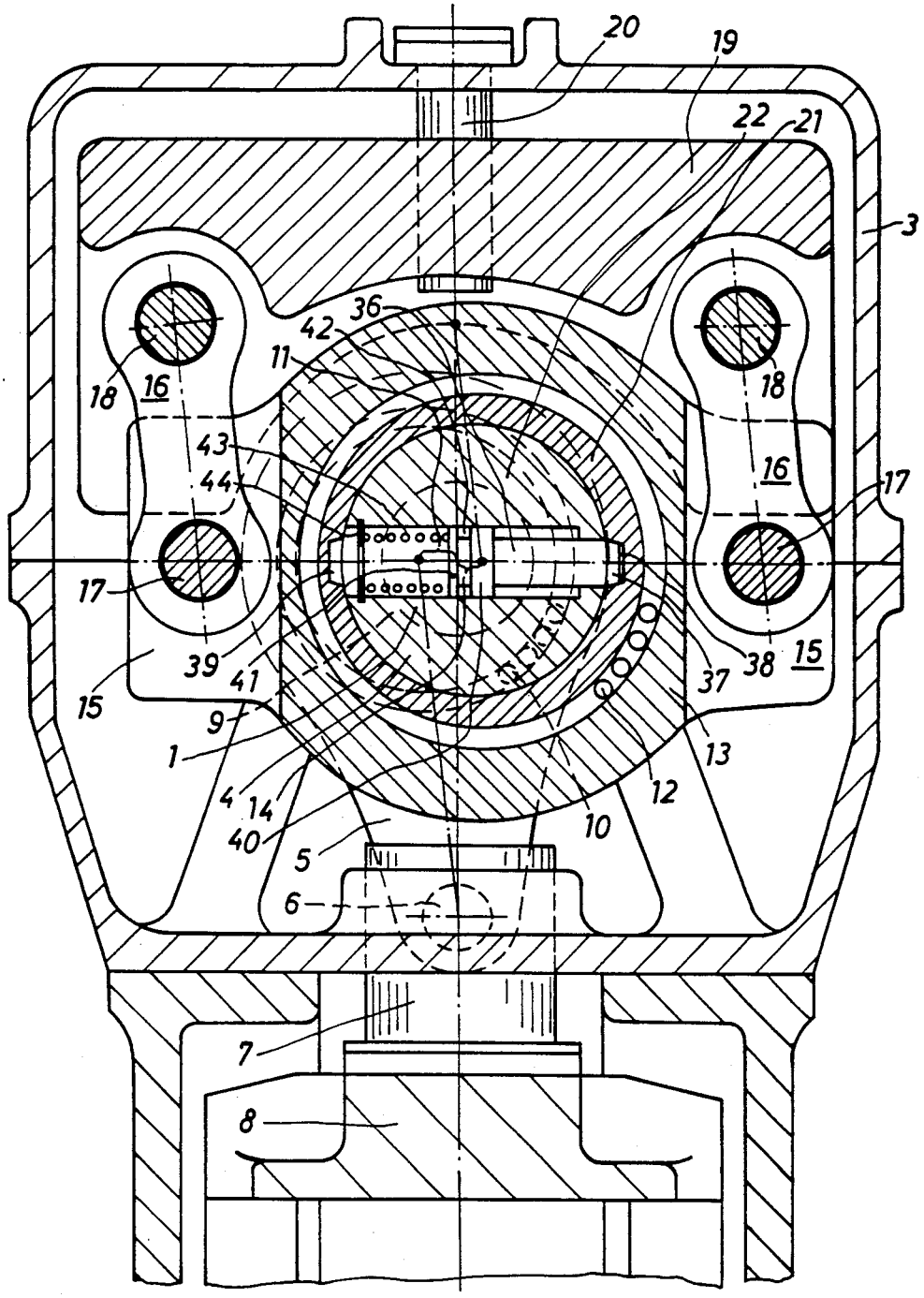
FIG. 2 illustrates a cross section of the embodiment shown in FIG. 1.

This yoke 13 is designed as counterbalance weight, which counterbalances the rotating forces. At both lateral end sections 15 of the yoke 13 a connecting rod 16 acting as lever is pivotably mounted via pivot pins 17. At their opposite end these connecting rods 16 are pivotably mounted to a counterbalance weight 19 via pivot pins 18. This counterbalance weight 19 is guided for vertical movement by means of at least one pin 20 (FIG. 2) rigidly mounted to the machine frame 3.

In operation the yoke 13 makes a homogeneous circular movement and counterbalances the rotating forces. The pivot pins 17 make the same circular movement and accordingly the connecting rods 16 are driven thereby. Conclusively, the pivot pins 18, by the agency of which the connecting rods 16 are pivotably mounted to the counterbalance weight 19 which is guided for vertical movement, make a vertical movement for driving said counterbalance weight 19. This vertically guided counterbalance weight 19 counterbalances accordingly the oscillating forces.

The first eccenter section 4 includes a first eccenter sleeve 21, which is rotatably supported on the eccenter shaft 1 and is designed simultaneously as inner ball bearing race. The second eccenter sections 9 include each a second eccenter sleeve 22, which eccenter sleeve 22 is also rotatably mounted on the eccenter shaft 1 and is also designed as inner ball bearing race.

The first eccenter sleeve 21 is drivingly coupled to both second eccenter sleeves 22. To this end the first eccenter sleeve 21 includes pins 23 projecting therefrom from its face sides in axial direction, which pins 23 support a slide ring 24 each. Both second eccenter sleeves 22 include a slot 25 extending in radial direction thereof and the slide rings 24 are received in the respective slots 25. If, accordingly, the first eccenter sleeve 21 is rotated, it moves the second eccenter sleeve 22 along, since the slide rings 24 supported on the pins 23 engage into the respective slots 25 located in the second eccenter sleeves 22.

The illustrated embodiment shows two locking means 26 arranged at the upper section of the machine frame 3. Both locking means 26 include a sleeve 27 rigidly mounted to the machine frame 3. A slide 28 is guided in each sleeve 27, which slide 28 ends at its upper end at a piston 29. Spiral pressure springs surround the slides 28, each pressure spring resting at one end on a shoulder surface 31 of sleeve 27 and at the other end against a piston 29 and accordingly biases the slide 28 into its rest position illustrated in the drawings. Both sleeves 27 are closed on top by a cover 32 and a feed channel 33 for a hydraulic fluid (or for pressurized air in case of a pneumatic control) extends through said cover 32. A distance piece 34 is arranged between the face surface of piston 29, which can be acted upon, and the bottom side of cover 32 such that a respective hydraulic pressure acts directly onto the complete piston surface. If a pressure is exerted onto the piston 19 through the fluid, which pressure exceeds the biassing force of springs 30, the slides 28 are displaced vertically downwards. These slides 28 will then slide into a slot 35 of the two second eccenter sleeves 22, which slots 35 extend in a radial direction thereof, and accordingly lock all three eccenter sleeves 21, 22 against rotation. In fact, the two second eccenter sleeves 22 are locked primarily and due to the drive connection to the first eccenter sleeve 21 via slot 25 and pin 23 including slide ring 24 the first eccenter sleeve 21 is locked secondarily. For sake of good order it must be noted that when locking the eccenter sleeves 21, 22 the eccenter shaft 1 is rotated by 180° from the position illustrated in FIG. 1 such that the slots 35 in the second eccenter sleeves 22 which in FIG. 1 face downwards are aligned with the slides 28 because they now face upwards.

A locking bolt 36 is displaceably supported in the first eccenter section 4 of the eccenter shaft 1. The head section 37 of this locking bolt 36 projects into a first recess 38 located at the inner wall of the first eccenter sleeve 21. A second recess 39 which may also receive the head section 37 of the locking bolt 36 is located in the eccenter sleeve 21 diametrically opposite of the first recess 38.

The locking bolt 36 is provided with a piston 40. The lower end of the locking bolt 36 is designed as disk 41 and an annular groove 42 is present between piston 40 and disk 41.

A spiral pressure spring 43 is arranged under the disk 41, which spring 43 bears at its remote end against a circlip 44 which is inserted in the first eccenter section. In place of the spiral pressure spring 43 it is possible to provide e.g. a disk spring package. Conclusively, it can be understood, that the locking bolt 36 is biassed by the spiral pressure spring 43 into engagement with the first or second, respectively, recess 38 or 39 of the first eccenter sleeve 21 and conclusively a force locked coupling between eccenter shaft 1 and first eccenter shaft 21 is achieved.

The cylinder space 45 above piston 40 communicates with a channel 46 extending axially through the eccenter shaft 1 and ending at a shaft sealing member 47, through which a hydraulic fluid is led through the channel 46 to the piston 40. Conclusively, if a fluid pressure acts onto piston 40, said pressure displaces the locking bolt 36 against the force of the spiral pressure spring 43 (or disk spring package, respectively) such to disengage from one of the recesses, e.g. recess 38, such that thereafter the first eccenter sleeve 21 and the second eccenter sleeves 22 which are taken along by the first eccenter sleeve 21 can be rotated on the respective eccenter sections 4, 9 of the eccenter shaft 1 until the locking bolt 36 is aligned with, for instance, recess 39.

In order to indicate the position of the locking bolt 36, i.e. if it is engaged with one respective of the two recesses 38, 39 or not, the locking bolt 36 is provided such as mentioned above with an annular groove 42. Furthermore, a shaft 48 extends axially through the eccenter shaft 1, which shaft 48 is provided with a lug 49 located offset relative to its center axis at the face end thereof adjacent the locking bolt 36, which axially projecting lug 49 engages into the annular groove 42. If now the locking bolt 36 is displaced due to the fluid pressure or spring force of spring 43, respectively, the lug 49 which projects into the annular groove 42 is taken along and accordingly the shaft 48 is made to rotate. The shaft 48 rotates (by an angle less than 180°) relative to the eccenter shaft 1 and accordingly, the rotational position of shaft 48 relative to the eccenter shaft 1 and accordingly, the position of the locking bolt 36 can be checked or supervised, respectively, from the outside of the machine frame 3. This observing can be made e.g. by an electrical feeling arrangement or a remote indication.

A change of the working stroke is carried out as follows. It shall be assumed, that the punching machine has been brought to a stop, whereby the structural members are in the position as illustrated in FIG. 1. The corresponding rotational position of the eccenter shaft 1 is observable at a location outside of the machine frame 3.

The eccenter shaft 1 is thereafter rotated out of the position illustrated in FIG. 1 by an angle of 180°, and accordingly, the slots 35 of the second eccenter sleeves 22 will align with the slides 28 of the locking means 26. The pressure of the fluid acting onto the pistons 29 is increased thereafter and accordingly, the slides 28 are moved into the slots 35 such that the eccenter sleeves 21 and 22 are locked against rotation. Thereafter fluid pressure is brought to act upon the piston 40 of the locking bolt 36 such that the locking bolt, i.e. specifically its head 37, slides out of recess 38. Now the eccenter sleeves can be rotated onto the eccenter shaft, i.e. they are rotatable relative to the eccenter shaft 1. The eccenter shaft 1 is now rotated by 180°, whereby the eccenter sleeves are locked and arrested, after which under 180° rotation the locking bolt 36 is aligned with the second recess 39. The fluid pressure acting onto the piston 40 of the locking bolt 36 is terminated such that the locking bolt 36 slides into the second recess 39 due to the force of the pressure spring 43. Thereafter the fluid pressure acting until now onto the pistons 29 of the slides 28 is terminated such that the slides 28 are lifted out of the slots 35 by the action of the springs 30. Conclusively, the eccenter sleeves 21, 22 have been rotated relative to the eccenter sections 4, 9 of the eccenter shaft and in conclusion the working stroke of the ram 8 has been finally changed.

While there is and described a present preferred embodiment of the invention, it is to be distinctly understood that the invention is not limited thereto, but may be otherwise variously embodied and practiced within the scope of the following claims.

I claim:

1. An apparatus for setting the working stroke of a punching machine which is selectably operable at two working strokes and includes two punch connecting rods drivingly coupled to a punching ram said apparatus comprises a rotatable eccenter shaft mounted on a machine frame and comprising a first eccenter section having two side faces and two second eccenter sections mounted adjacent to and on the side faces of the first eccenter section, which first eccenter section is allocated to drive machine members which are operative for the balancing of masses of the oscillating and rotating forces during machine operation and is provided with a first eccenter rotatably supported thereupon, which second eccenter sections are allocated to drive the two punch connecting rods and are each provided with a second eccenter sleeve rotatably supported thereupon, said first eccenter sleeve is releasably form-locked to said first eccenter section and thus to said eccenter shaft and is at both sides continuously drivingly coupled to said second eccentric sleeves; a locking means is supported by the machine frame and has an inoperative position and a locking position and in its locking position locks all eccenter sleeves against rotating; a locking bolt slidingly supported in said first eccenter, which locking bolt provides a releasably formed-locked coupling of said first eccenter sleeve to said first eccenter section, which first eccenter sleeve comprises two recesses located in its inner wall at a mutual distance from one another and intended to respectively receive a head section of said locking bolt, whereby one of said working strokes is set; said first eccenter sleeve is drivingly coupled to said second eccenter sleeves by slidingly engaged force transmitting members, and said locking means supported by the machine frame comprises at least one slide member guide in the machine frame and each second eccenter sleeve comprises a slot for receiving one of said at least one slide member, whereby all eccenter sleeves are locked against rotation upon receipt of said at least one slide member in said eccenter sleeve slots, said first eccenter sleeve comprises at each side face a pin projecting axially thereof and supporting a slide ring arranged thereupon, and each second eccenter sleeve comprises a further slot in which one respective of said pins and its slide ring is received such to complete the drive connection between the eccenter sleeves.

2. The apparatus of claim 1, in which said locking bolt is coupled to a position indication transmitter leading towards the outside of the machine frame, whereby the respective positions of said locking bolt may be visibly indicated at a visibly accessible location at the outside of the machine frame.

3. The apparatus of claim 2, in which said position indication transmitter comprises a shaft extending axially within the eccenter shaft, which axially extending shaft is provided at its face end adjacent said locking bolt with an axially projecting bolt offset relative to the longitud,inal axis thereof, said locking bolt further comprises an annular groove in which said axially projecting bolt is received, whereby a translatory displacement of said locking bolt results in a rotational movement of said shaft.

4. An apparatus for setting the working stroke of a punching machine which is selectably operable at two working strokes and includes two punch connecting rods drivingly coupled to a punching ram, said apparatus comprises a rotatable eccenter shaft mounted on a machine frame and comprising a first eccenter section having two side faces and two second eccenter sections mounted adjacent to and on the side faces of the first eccenter section, which first eccenter section is allocated to drive machine members which are operative for the balancing of masses of the oscillating and rotating forces during machine operation and is provided with a first eccenter sleeve rotatably supported thereupon, which second eccenter sections are alocated to drive the two punch connecting rods and are each provided with a second eccenter sleeve rotatably supported thereupon; said first eccenter sleeve is releasably form-locked to said first eccenter section and thus to said eccenter shaft and is at both sides continuously drivingly coupled to one said second eccenter sleeves, and in which a locking means is supported by the machine frame and has an inoperative position and a locking position and in its locking position locks all eccenter sleeves against rotating; a locking bolt slidingly supported in said first eccenter, which locking bolt provides a releasably formed-locked coupling of said first eccenter sleeve to said first eccenter section, which first eccenter sleeve comprises two recesses located in its inner wall at a mutual distance from one another and intended to respectively receive the head section of said locking bolt, whereby one on said working strokes is set, said first eccenter sleeve is drivingly coupled to said second eccenter sleeves by slidingly engaged force transmitting members; said locking means supported by the machine frame comprises at least one slide member guided in the machine frame and each second eccenter sleeve comprises a slot for receipt of one respective slide member, whereby all eccenter sleeves are locked against rotation upon receipt of said at least one slide member in said eccenter sleeve slot; said locking bolt is spring biassed into engagement with one of said two recesses located in said first eccenter sleeve and includes a piston driven by a hydraulic fluid fed thereto through a fluid channel extending through said eccenter shaft, whereby an increase of the pressure of said fluid will force said locking bolt against the spring bias out of engagement with said respective recess.

5. The apparatus of claim 4, in which said locking bolt is coupled to a position indication transmitter leading towards the outside of the machine frame, whereby the respective positions of said locking bolt may be visibly indicated at a visibly accessible location at the outside of the machine frame.

6. The apparatus of claim 5, in which said position indication transmitter comprises a shaft extending axially within the eccenter shaft, which axially extending shaft is provided at its face end adjacent said locking bolt with an axially projecting bolt offset relative to the longitudinal axis thereof, said locking bolt further comprises an annular groove in which said axially projecting bolt is received, whereby a translatory displacement of said locking bolt results in a rotational movement of said shaft.

* * * * *